US009568882B2

(12) United States Patent
Suzuki

(10) Patent No.: US 9,568,882 B2
(45) Date of Patent: Feb. 14, 2017

(54) CLEANING DEVICE AND IMAGE FORMING APPARATUS

(71) Applicant: FUJI XEROX CO., LTD., Tokyo (JP)

(72) Inventor: Toshihiko Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/711,365

(22) Filed: May 13, 2015

(65) Prior Publication Data

US 2016/0187835 A1 Jun. 30, 2016

(30) Foreign Application Priority Data

Dec. 26, 2014 (JP) ..... 2014-265488

(51) Int. Cl.
*G03G 21/00* (2006.01)
*G03G 15/34* (2006.01)

(52) U.S. Cl.
CPC ..... *G03G 21/0011* (2013.01); *G03G 21/0088* (2013.01); *G03G 15/342* (2013.01)

(58) Field of Classification Search
USPC ..... 399/237
See application file for complete search history.

(56) References Cited

U.S. PATENT DOCUMENTS 5,946,531 A * 8/1999 Miura ..... G03G 21/1814 399/111
2003/0152407 A1* 8/2003 Hatano ..... G03G 21/0005 399/350
2008/0063448 A1* 3/2008 Hozumi ..... G03G 21/0029 399/350
2009/0103949 A1* 4/2009 Chiba ..... G03G 15/11 399/249
2010/0143010 A1* 6/2010 Shirai ..... G03G 21/0035 399/354
2012/0219325 A1* 8/2012 Sasaki ..... G03G 15/104 399/237

FOREIGN PATENT DOCUMENTS

JP H1165292 A 3/1999
JP 2006243053 A 9/2006

* cited by examiner

*Primary Examiner* — Clayton E Laballe
*Assistant Examiner* — Linda B Smith
(74) *Attorney, Agent, or Firm* — Oliff PLC

(57) ABSTRACT

A cleaning device includes a plate-shaped scraping member that scrapes a liquid developer which remains on an outer circumferential surface of a holding member by contacting an edge portion with the outer circumferential surface, a first collecting member that collects the liquid developer scraped by the scraping member, and a second collecting member that collects the liquid developer which passes through the scraping member, is attached to an under surface of the scraping member, and falls.

11 Claims, 4 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2014-265488 filed Dec. 26, 2014.

BACKGROUND

Technical Field

The present invention relates to a cleaning device and an image forming apparatus.

SUMMARY

According to an aspect of the invention, there is provided a cleaning device including:

a plate-shaped scraping member that scrapes a liquid developer which remains on an outer circumferential surface of a holding member by contacting an edge portion with the outer circumferential surface;

a first collecting member that collects the liquid developer scraped by the scraping member; and a second collecting member that collects the liquid developer which passes through the scraping member, is attached to an under surface of the scraping member, and falls.

BRIEF DESCRIPTION OF THE DRAWINGS

Exemplary embodiments of the present invention will be described in detail based on the following figures, wherein.

DETAILED DESCRIPTION

Figure 1:
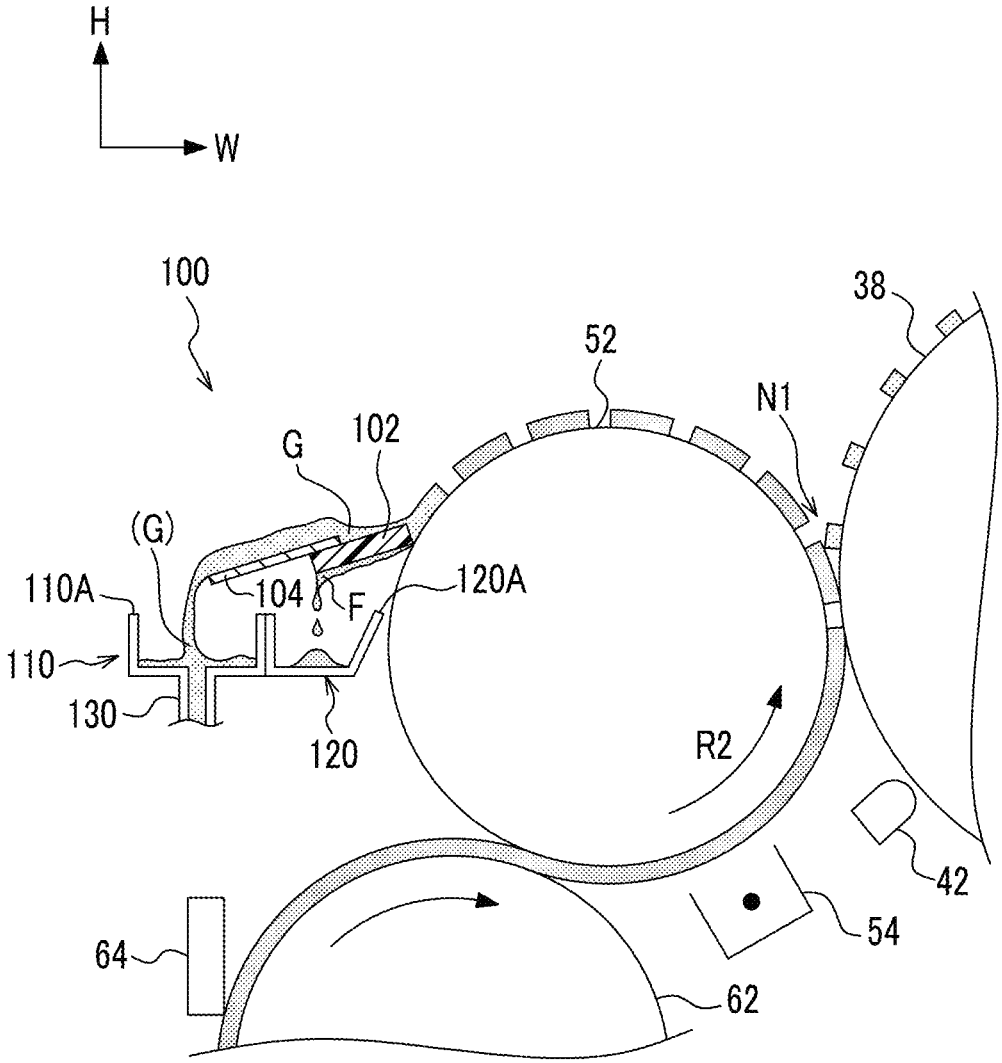
FIG. 1 is a configuration view illustrating a cleaning device according to an exemplary embodiment of the invention.

An example of a cleaning device and an image forming apparatus according to an exemplary embodiment of the invention will be described with reference to FIGS. 1 to 4. In addition, an arrow H illustrated in the drawings illustrates an apparatus up-and-down direction (vertical direction), and an arrow W illustrates an apparatus width direction (horizontal direction).

Entire Configuration

Figure 4:
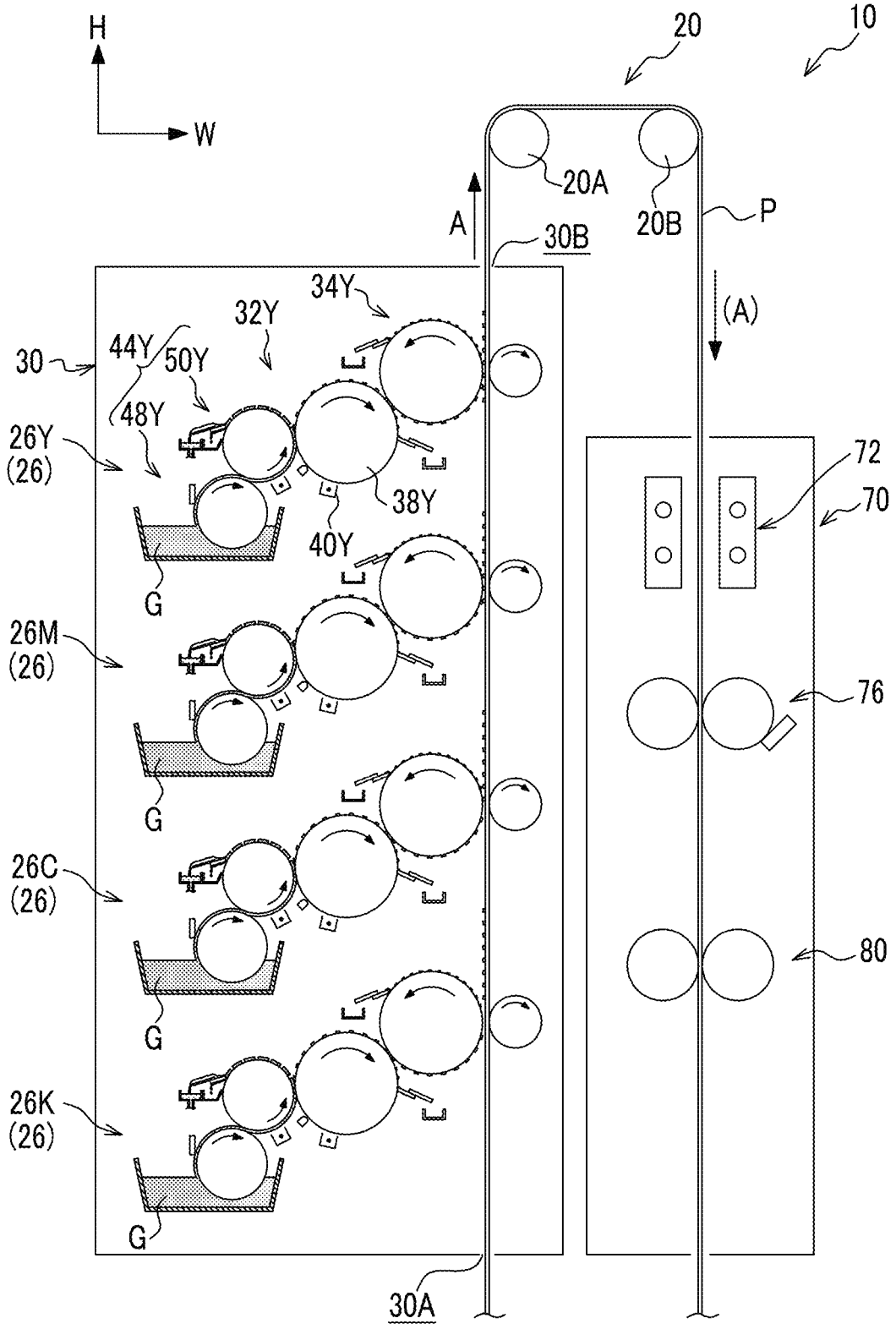
FIG. 4 is a schematic configuration view illustrating the image forming apparatus according to the exemplary embodiment of the invention.

As illustrated in FIG. 4, an image forming apparatus 10 includes a transporting portion 20 which transports a sheet of continuous paper P as a recording medium, an image forming portion 26 which forms a toner image, and a fixing device 70 which fixes the toner image onto the continuous paper P.

Transporting Portion

The transporting portion 20 has a function of transporting the continuous paper P in an arrow A direction (transporting direction) illustrated in the drawing at a transporting speed set in advance. Furthermore, the continuous paper P is wound around the transporting portion 20, and the transporting portion 20 includes a pair of transporting rolls 20A and 20B which are disposed to be aligned in the apparatus width direction. In addition, the transporting roll 20A is disposed on an upstream side (left side in the drawing) of the transporting direction (hereinafter, referred to as a "medium transporting direction") of the continuous paper P, with respect to the transporting roll 20B.

In this configuration, on the upstream side with respect to the transporting roll 20A in the medium transporting direction, the continuous paper P is transported to the upstream side from the downstream side in the drawing, and on the downstream side with respect to the transporting roll 20B in the medium transporting direction, the continuous paper P is transported to the downstream side from the upstream side in the drawing. A transporting speed of the continuous paper P is 60 [m/min] as an example.

Image Forming Portion

The image forming portion 26 includes an image forming portion 26Y which forms an image in a yellow color (Y), an image forming portion 26M which forms an image in a magenta color (M), an image forming portion 26C which forms an image in a cyan color (C), and an image forming portion 26K which forms an image in a black color (K). From the upstream side in the medium transporting direction, the image forming portion 26K, the image forming portion 26C, the image forming portion 26M, and the image forming portion 26Y are disposed in this order. In addition, the image forming portion 26K, the image forming portion 26C, the image forming portion 26M, and the image forming portion 26Y are disposed inside a housing 30.

In addition, at a part on a lower side of the housing 30, an opening portion 30A through which the continuous paper P transported by the transporting portion 20 enters the housing 30 is formed, and at a part on an upper side of the housing 30, an opening portion 30B which discharges the continuous paper P which enters the housing 30 to the outside of the housing 30 is formed.

In addition, the image forming portion 26K, the image forming portion 26C, the image forming portion 26M, and the image forming portion 26Y are basically configured similarly to each other except for a liquid developer G to be used. In the description below, unless there is particular distinction, "Y", "M", "C", and "K" at the end of the reference numerals will be omitted.

Figure 3:
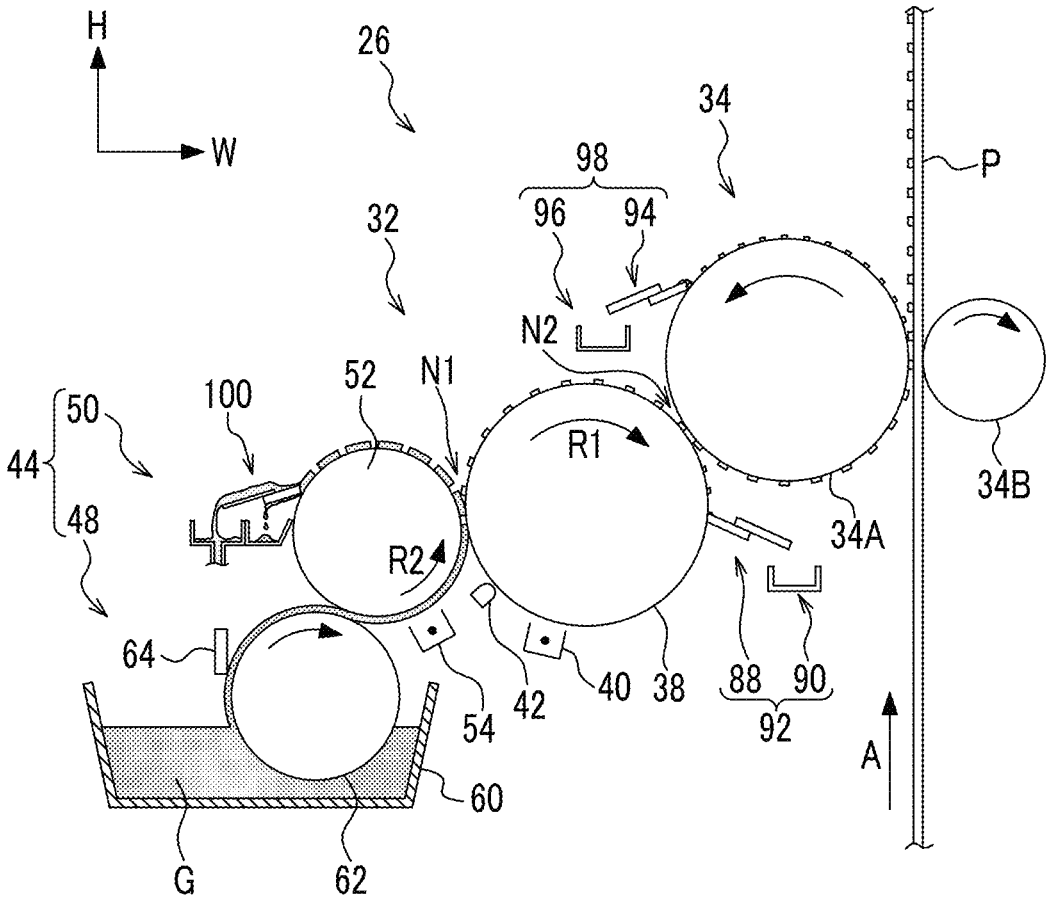
FIG. 3 is a configuration view illustrating an image forming portion which is used in an image forming apparatus according to the exemplary embodiment of the invention.

As illustrated in FIG. 3, the image forming portion 26 uses the liquid developer G which includes toner and insulating liquid, and includes an image forming unit 32 for forming the toner image and a transfer unit 34 for transferring the toner image formed by the image forming unit 32 to the continuous paper P.

Image Forming Unit

The image forming unit 32 includes an image holding member 38 which holds the toner image, a charging device 40 which charges the image holding member 38, an exposure device 42 which irradiates the image holding member 38 with exposure light and forms an electrostatic latent image, and a developing device 44 which develops the electrostatic latent image on the image holding member 38 as the toner image.

Image Holding Member

The image holding member 38 has a cylindrical shape, and is rotationally driven around an axis (arrow R1 direction) by a driving unit (not illustrated). The image holding member 38 is a positively charged amorphous silicon photoconductor which is formed of an aluminum substrate, and a carrier injection preventing layer, a photoconductive layer, and a surface protective layer on the substrate in order (not illustrated).

Furthermore, a cleaning device 92, which includes a scraping blade 88 which scrapes the liquid developer G that remains on an outer circumferential surface of the image holding member 38 without transferring the liquid developer G to a transfer roll 34A which will be described later from above the image holding member 38, and a collecting member 90 which collects the scraped liquid developer G, are provided.

Charging Device

In the exemplary embodiment, the charging device 40 is a scorotron type charging device, and is disposed to face the outer circumferential surface of the image holding member 38. The charging device 40 charges the outer circumferential surface of the image holding member 38.

Exposure Device

In the exemplary embodiment, the exposure device 42 is an LED print head, and is disposed to face the outer circumferential surface of the image holding member 38 on the downstream side of the charging device 40 in a rotating direction of the image holding member 38. The exposure device 42 irradiates the outer circumferential surface of the image holding member 38 which is charged by the charging device 40 with the exposure light, and forms the electrostatic latent image on the outer circumferential surface thereof.

Developing Device

The developing device 44 includes a developing portion 50 which delivers the liquid developer G to the electrostatic latent image formed on the image holding member 38, and a rotatable supply portion 48 which supplies the liquid developer G to the developing portion 50. The liquid developer G which is used in the exemplary embodiment is the liquid type liquid developer G in which the toner (particle) is dispersed to carrier liquid. As the carrier liquid, for example, an insulating liquid, such as vegetable oil, liquid paraffin oil, or silicone oil, is used. In addition, in the liquid developer G, for example, an average particle diameter of the toner (particle) is 0.5 μm to 5 μm, and the toner (particle) is dispersed at a concentration of 15 wt % to 45 wt % in the carrier liquid.

Developing Portion

The developing portion 50 has a cylindrical shape, and includes a developing roll 52 as an example of the developing member which is rotationally driven (arrow R2 direction) in the same direction as that of a moving direction of the surface of the image holding member 38 by the driving unit (not illustrated), and a charging member 54 which is disposed to face the developing roll 52. Furthermore, the developing portion 50 includes a cleaning device 100 which collects the liquid developer G that remains on the outer circumferential surface of the developing roll 52 and cleans the outer circumferential surface of the developing roll 52.

A developing voltage is applied to the developing roll 52 by a power source (not illustrated), and an electric field for developing the electrostatic latent image on the outer circumferential surface of the image holding member 38 is formed between the developing roll 52 and the image holding member 38 (nip portion N1). Furthermore, between the developing roll 52 and a supply roll 62 which will be described later, an electric field for supplying the liquid developer G is formed on the outer circumferential surface of the developing roll 52 from the supply roll 62.

In the exemplary embodiment, the charging member 54 is a scorotron type charging device, and is used for charging the toner included in the liquid developer G. The charging member 54 is disposed to face the outer circumferential surface of the developing roll 52 on the upstream side with respect to the nip portion N1 in the rotating direction of the developing roll 52. In addition, the cleaning device 100 will be described in detail later.

In this configuration, the charging member 54 charges the toner which is included in the liquid developer G supplied to the outer circumferential surface of the developing roll 52, and the liquid developer G which includes the charged toner is delivered to the electrostatic latent image formed on the image holding member 38 from the outer circumferential surface of the developing roll 52. Accordingly, the developing portion 50 develops the electrostatic latent image formed on the image holding member 38 as the toner image. In addition, when developing the electrostatic latent image as the toner image by using the liquid developer G, the oil also moves to the image holding member 38.

Supply Portion

The supply portion 48 is disposed on the lower side of the developing roll 52, and includes an accommodation vessel 60 which accommodates the liquid developer G and the supply roll 62 which pumps up the liquid developer G from the accommodation vessel 60 and supplies the liquid developer G to the outer circumferential surface of the developing roll 52. In addition, the supply portion 48 includes a regulating blade 64 which adjusts a layer thickness of the liquid developer G attached to the supply roll 62.

On the outer circumferential surface of the supply roll 62, as an example, an engraved groove having a sloped line pattern is formed. In addition, as a shape of the engraved groove of the surface of the supply roll 62, in addition to the sloped line pattern, a pyramid type pattern, a grid type pattern, or a honeycomb type pattern may be used.

In this configuration, the supply roll 62 which is rotationally driven pumps the liquid developer G accommodated in the accommodation vessel 60, and the regulating blade 64 adjusts the layer thickness of the liquid developer G. Furthermore, by the electric field which is formed between the supply roll 62 and the developing roll 52, the liquid developer G which is pumped by the supply roll 62 is supplied to the outer circumferential surface of the developing roll 52. Accordingly, a film (layer) of the liquid developer G is formed on the outer circumferential surface of the developing roll 52.

Transfer Unit

The transfer unit 34 is disposed to face the image holding member 38, and includes the transfer roll 34A as an example of an intermediate holding member to which the toner image held by the image holding member 38 is transferred. Furthermore, the transfer unit 34 includes a back-up roll 34B as an example of the transfer member which nips the continuous paper P and is disposed on a side opposite to the transfer roll 34A.

A primary transfer voltage is applied to the transfer roll 34A by the power source (not illustrated). Accordingly, between the transfer roll 34A and the image holding member 38 (nip portion N2), the electric field for transferring the toner image on the image holding member 38 to the transfer roll 34A is formed.

In addition, a secondary transfer voltage is applied to the back-up roll 34B by the power source (not illustrated). Accordingly, between the back-up roll 34B and the transfer roll 34A, the electric field for transferring the toner image on the transfer roll 34A to the continuous paper P is formed.

Furthermore, a cleaning device 98, which includes a scraping blade 94 which scrapes the liquid developer G that remains on the outer circumferential surface of the transfer roll 34A from the transfer roll 34A without transferring the liquid developer G to the continuous paper P from above the transfer roll 34A, and a collecting member 96 which collects the scraped liquid developer G, are provided.

In this configuration, the toner image which is held by the image holding member 38 is transferred to the transfer roll 34A, and the toner image which is transferred to the transfer roll 34A is transferred to the continuous paper P. In addition, the oil which moves to the image holding member 38 from the developing roll 52 also similarly moves to the continuous paper P via the transfer roll 34A.

Fixing Device

As illustrated in FIG. 4, the fixing device 70 includes a heating portion 72 which heats the continuous paper P, an oil removing portion 76 which removes the oil from the continuous paper P, and a fixing portion 80 which fixes the toner image to the continuous paper P.

In this configuration, by the heating portion 72, the continuous paper P is heated, the toner and the oil which are included in the liquid developer G on the continuous paper P are separated, and a layer of the oil is formed on an upper layer of the toner. Furthermore, the oil is removed by the oil removing portion 76, and by the fixing portion 80, the continuous paper P is heated and pressurized, and the toner image is fixed to the continuous paper P.

Operation of Entire Configuration

The image holding member 38 of the image forming unit 32 of each color rotates, and the outer circumferential surface of the image holding member 38 is charged by the charging device (refer to FIG. 3). Next, the exposure device 42 exposes the outer circumferential surface of the charged image holding member 38 and forms the electrostatic latent image (not illustrated) on the outer circumferential surface of the image holding member 38, in accordance with image data which is received from an image signal processing portion (not illustrated). The electrostatic latent image is developed as the toner image by the developing device 44.

The toner image which is formed on the outer circumferential surface of the rotating image holding member 38 is primarily transferred to the transfer roll 34A. The toner image which is primarily transferred to the transfer roll 34A is transferred to the transported continuous paper P. At this time, the oil together with the toner image moves to the continuous paper P. This process is performed in the image forming portion 26 of each color, and the toner image in which each color is superimposed is formed on the continuous paper P.

Furthermore, the oil in the transported continuous paper P is removed by the fixing device 70, and the toner image is fixed to the continuous paper P (refer to FIG. 4).

Main Configuration

Next, the cleaning device 100 will be described.

As illustrated in FIG. 1, the cleaning device 100 includes a scraping blade 102 which is an example of the scraping member in which an edge portion contacts with the outer circumferential surface of the developing roll 52, and a supporting blade 104 which supports a base end side of the scraping blade 102. Furthermore, the cleaning device 100 includes a collecting member 110 as an example of a first collecting member which collects the liquid developer G scraped by the scraping blade 102. In addition, the cleaning device 100 includes a collecting member 120 as an example of a second collecting member which collects the liquid developer G which passes through the scraping blade 102 and is attached to aback surface of the scraping blade 102.

The scraping blade 102 is a plate-shaped rubber blade which extends in an apparatus depth direction (paper surface depth direction), and is disposed on an upper side of the supply roll 62. In other words, the supply roll 62 is disposed on a lower side of the scraping blade 102. In the rotating direction of the developing roll 52, the edge portion of the scraping blade 102 contacts with the outer circumferential surface of the developing roll 52 of a part on the downstream side with respect to the nip portion N1. Furthermore, when viewed from the apparatus depth direction, the scraping blade 102 is inclined so that the part on the edge side of the scraping blade 102 is positioned on the upper side compared to the part on the base end side.

The supporting blade 104 is a plate metal member which extends in the apparatus depth direction (paper surface depth direction), and both end portions in a longitudinal direction are supported by a frame member (not illustrated). The edge side (right side in the drawing) of the supporting blade 104 is overlapped on the base end side of the scraping blade 102 from the upper side, and by an anchoring unit (not illustrated), the base end side of the scraping blade 102 is anchored to the supporting blade 104. In this manner, the supporting blade 104 supports the base end side of the scraping blade 102. Furthermore, when viewed from the apparatus depth direction, the supporting blade 104 is inclined so that the part on the edge side of the supporting blade 104 is positioned on the upper side compared to the part on the base end side.

The collecting member 110 is a member which extends in the apparatus depth direction (paper surface depth direction), and has a shape of a box in which an opening portion 110A which is opened on the upper side thereof is formed, and is disposed on the lower side with respect to the part on the base end side of the supporting blade 104. Both end portions of the collecting member 110 in the longitudinal direction are supported by the frame member (not illustrated). Furthermore, one end of a transport pipe 130 for transporting the liquid developer G collected by the collecting member 110 to the accommodation vessel 60 (FIG. 3) from the collecting member 110 via a concentration adjust portion (not illustrated) is connected to a bottom plate of the collecting member 110.

The collecting member 120 is a member which extends in the apparatus depth direction (paper surface depth direction) and has a shape of a box in which an opening portion 120A which is opened on the upper side thereof is formed, and is disposed on the lower side with respect to the part on the base end side of the scraping blade 102 and on the upper side with respect to the supply roll 62. In other words, the collecting member 120 is disposed between the scraping blade 102 and the supply roll 62. Both end portions of the collecting member 120 in the longitudinal direction are supported by the frame member (not illustrated).

Operation of Main Configuration

Next, the operation of the main configuration will be described.

The liquid developer G is supplied to the outer circumferential surface of the rotating developing roll 52 from the rotating supply roll 62 (refer to FIG. 1). Furthermore, the charging member 54 charges the toner which is included in the liquid developer G supplied to the outer circumferential surface of the developing roll 52, and the liquid developer G which includes the charged toner is delivered to the electrostatic latent image which is formed on the image holding member 38 from the outer circumferential surface of the developing roll 52.

In addition, without being delivered to the image holding member 38, most of the liquid developer G which remains on the outer circumferential surface of the developing roll 52 is scraped by the scraping blade 102, and flows on the upper surface (surface which is oriented to the upper side in the drawing) of the scraping blade 102 and the upper surface (surface which is oriented to the upper side in the drawing) of the supporting blade 104. In addition, the liquid developer G which flows on the upper surface of the supporting blade 104 falls from the base end side of the supporting blade 104, and is collected to the collecting member 110 from the opening portion 110A. Furthermore, the liquid developer G which is collected by the collecting member 110 flows inside the transport pipe 130 and is transported to the accommodation vessel 60 (FIG. 3). In this manner, the liquid developer G which is scraped by the scraping blade 102 is reused.

Meanwhile, apart of the liquid developer G which remains on the outer circumferential surface of the rotating developing roll 52 passes through between the edge of the scraping blade 102 and the outer circumferential surface of the developing roll 52.

Here, the toner concentration (concentration of toner with respect to oil) of the liquid developer G which passes through the scraping blade 102 increases and the liquid developer G becomes lumpy. This is because a large amount of oil is scraped by the scraping blade 102.

Figure 2:
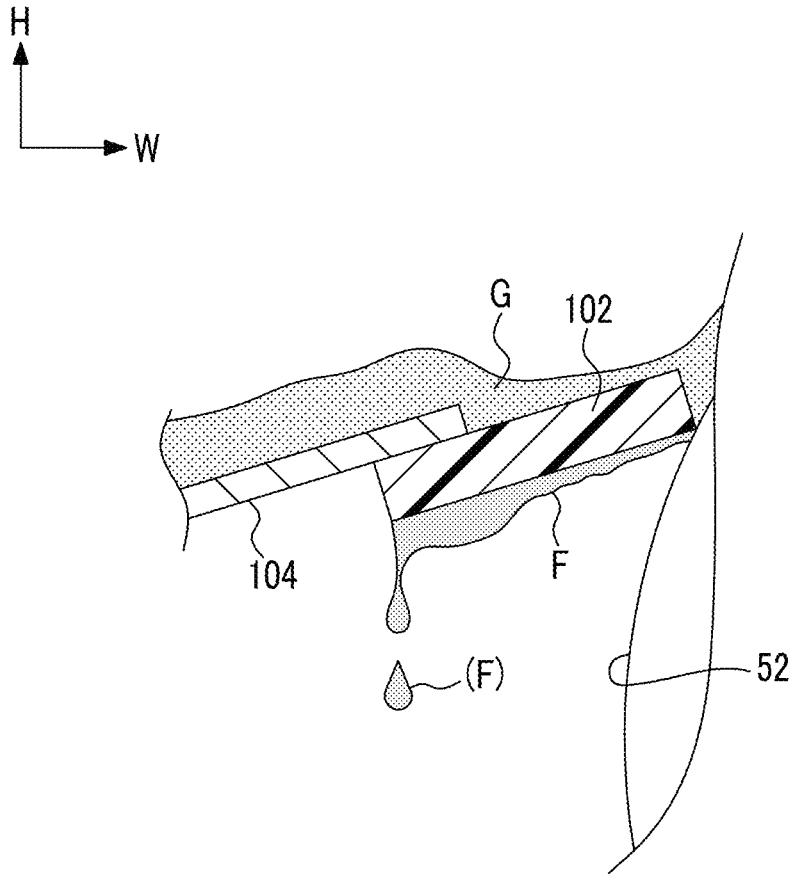
FIG. 2 is a cross-sectional view illustrating a scraping blade which is used in the cleaning device according to the exemplary embodiment of the invention.

The liquid developer G which passes through the scraping blade 102 and of which the toner concentration increases has high viscosity, and the liquid developer G (hereinafter, referred to as a "high viscosity developer F") is attached to the under surface (surface which is oriented to the lower side in the drawing) of the scraping blade 102. As illustrated in FIG. 2, the high viscosity developer F which is attached to the under surface of the scraping blade 102 crosses the under surface of the scraping blade 102 and reaches a part of the base end side of the scraping blade 102. In addition, the high viscosity developer F becomes lumpy and falls from the part of the base end side of the scraping blade 102.

As illustrated in FIG. 1, the high viscosity developer F which becomes lumpy and falls is collected to the collecting member 120 from the opening portion 120A.

CONCLUSION

As described above, in addition to the collecting member 110 which collects the liquid developer G scraped from the developing roll 52 by the scraping blade 102, the collecting member 120 which collects the high viscosity developer F which passes through the scraping blade 102 is provided. Accordingly, in addition to the liquid developer G which is scraped by the scraping blade 102, the high viscosity developer F which passes through the scraping blade 102 is collected.

In addition, the opening portion 120A of the collecting member 120 is disposed on the lower side with respect to a part of the base end side of the scraping blade 102. For this reason, the high viscosity developer F which crosses the under surface of the scraping blade 102, reaches the base end side of the scraping blade 102, becomes lumpy, and falls, is collected to the collecting member 120.

In addition, the collecting member 120 is disposed between the scraping blade 102 and the supply roll 62. For this reason, the high viscosity developer F which falls from the under surface of the scraping blade 102 is prevented from being attached to the outer circumferential surface of the supply roll 62.

In addition, in the image forming apparatus 10, by suppressing attachment to the outer circumferential surface of the supply roll 62, it is possible to suppress a deterioration of quality of an output image.

In addition, in the image forming apparatus 10, in addition to the liquid developer G which is scraped by the scraping blade 102, as the high viscosity developer F which passes through the scraping blade 102 is collected, the liquid developer G which is scraped by the scraping blade 102 may be reused.

In addition, a specific exemplary embodiment of the invention is described in detail, but the invention is not limited to the exemplary embodiment, and it is apparent for those skilled in the art that other various exemplary embodiments within the range of the invention may be employed. For example, in the above-described exemplary embodiment, a case where the liquid developer G which remains in the developing roll 52 is cleaned is described as an example. However, the cleaning device 100 may be used in cleaning the liquid developer G which remains on the image holding member 38, and the cleaning device 100 may be used in cleaning the liquid developer G which remains in the transfer roll 34A. Accordingly, it is possible to reuse the liquid developer G which remains on the image holding member 38 and the liquid developer G which remains in the transfer roll 34A.

In addition, in the above-described embodiment, the image forming apparatus 10 is provided with the transfer roll 34A. However, the toner image may be directly transferred to the continuous paper P from the image holding member without providing the transfer unit 34.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a plate-shaped scraping member that scrapes a developer which remains on an outer circumferential surface of a holding member by contacting an edge portion with the outer circumferential surface;

a first collecting member that collects the developer scraped by the scraping member;

a second collecting member that collects the developer which passes between the scraping member and the outer circumferential surface of the holding member, is attached to an under surface of the scraping member, and falls, and wherein the second collecting member collects the developer which flows along an under surface of the scraping member, after being scraped by the scraping member.

2. The cleaning device according to claim 1, wherein the second collecting member has an opening portion that receives the developer, and the opening portion is disposed on a lower side with respect to a portion of a base end side of the scraping member.

3. The cleaning device according to claim 1, wherein the holding member is a developing member that develops an electrostatic latent image on an image holding member by the developer, a rotatable supply member that supplies the developer to the developing member is disposed on a lower side of the scraping member, and the second collecting member is disposed between the scraping member and the supply member in a vertical direction.

4. The cleaning device according to claim 1, wherein the holding member is an image holding member on which a toner image is formed.

5. The image forming apparatus according to claim 1, wherein the first collecting member and the second collecting member are separated from each other.

6. An image forming apparatus comprising:

an image holding member on which an electrostatic latent image is formed;

a developing member that develops the electrostatic latent image on the image holding member to form a toner image using a developer;

a transfer member that transfers the toner image formed on the image holding member to a recording medium; and the cleaning device according to claim 1 that cleans an outer circumferential surface of at least one of the developing member and the image holding member.

7. The image forming apparatus according to claim 6, wherein the second collecting member of the cleaning device has an opening portion which receives the developer, and the opening portion is disposed on a lower side with respect to a portion on a base end side of the scraping member.

8. An image forming apparatus comprising:

an image holding member on which an electrostatic latent image is formed;

a developing member that develops the electrostatic latent image on the image holding member to form a toner image using a developer;

an intermediate holding member to which the toner image formed on the image holding member is transferred, and which intermediately holds the toner image before the toner image is transferred to a recording medium;

a transfer member that transfers the toner image transferred to the intermediate holding member to the recording medium; and the cleaning device according to claim 1 that cleans an outer circumferential surface of the intermediate holding member.

9. The image forming apparatus according to claim 8, wherein the second collecting member has an opening portion which receives the developer, and the opening portion is disposed on a lower side with respect to a portion on a base end side of the scraping member.

10. A cleaning device comprising:

a plate-shaped scraping member that scrapes a developer which remains on an outer circumferential surface of a holding member by contacting an edge portion with the outer circumferential surface;

a first collecting member that collects the developer scraped by the scraping member;

a second collecting member that collects the developer which passes between the scraping member and the outer circumferential surface of the holding member, is attached to an under surface of the scraping member, and falls, and a supporting blade that supports a base end side of the scrapping member and wherein the first collecting member collects toner that falls from the supporting blade.

11. A cleaning device comprising:

a plate-shaped scraping member that scrapes a developer which remains on an outer circumferential surface of a holding member by contacting an edge portion with the outer circumferential surface;

a first collecting member that collects the developer scraped by the scraping member;

a second collecting member that collects the developer which passes between the scraping member and the outer circumferential surface of the holding member, is attached to an under surface of the scraping member, and falls, and the second collecting member is disposed on a lower side with respect to a part on a base end side of the plate-shaped scraping member and on the upper side with respect to a supply roll.

* * * * *